United States Patent [19]

Gord

[11] Patent Number: 4,990,845

[45] Date of Patent: Feb. 5, 1991

[54] FLOATING CURRENT SOURCE

[75] Inventor: John C. Gord, Los Angeles County, Calif.

[73] Assignee: Alfred E. Mann Foundation for Scientific Research, Sylmar, Calif.

[21] Appl. No.: 428,179

[22] Filed: Dec. 18, 1989

[51] Int. Cl.[5] ..... G05F 3/08; G05F 3/16

[52] U.S. Cl. ..... 323/312; 323/316; 307/296.1

[58] Field of Search ..... 323/312, 315, 316; 307/296.8, 296.1, 490

[56] References Cited

U.S. PATENT DOCUMENTS 3,760,199 9/1973 Graeme ..... 307/296.1

4,546,307 10/1985 Llewellyn ..... 323/315

FOREIGN PATENT DOCUMENTS 3038197 4/1982 Fed. Rep. of Germany ..... 323/312

*Primary Examiner*—Steven L. Stephan

*Assistant Examiner*—Nilay H. Vyas

*Attorney, Agent, or Firm*—Robert R. Meads

[57] ABSTRACT

A floating current source comprising two identically sized field effect transistors, one defining a reference transistor and the other defining a floating output transistor. The reference transistor has its gate connected to a reference voltage and its source connected to receive an input current from an input current source and to generate a gate-to-source voltage which when applied as a gate-to-source voltage of the floating output transistor will generate an output current in the output transistor equal to the input current. Circuit means are included for applying between the gate and source of the output transistor a voltage equal to the gate-to-source drain voltage of the reference transistor.

4 Claims, 1 Drawing Sheet

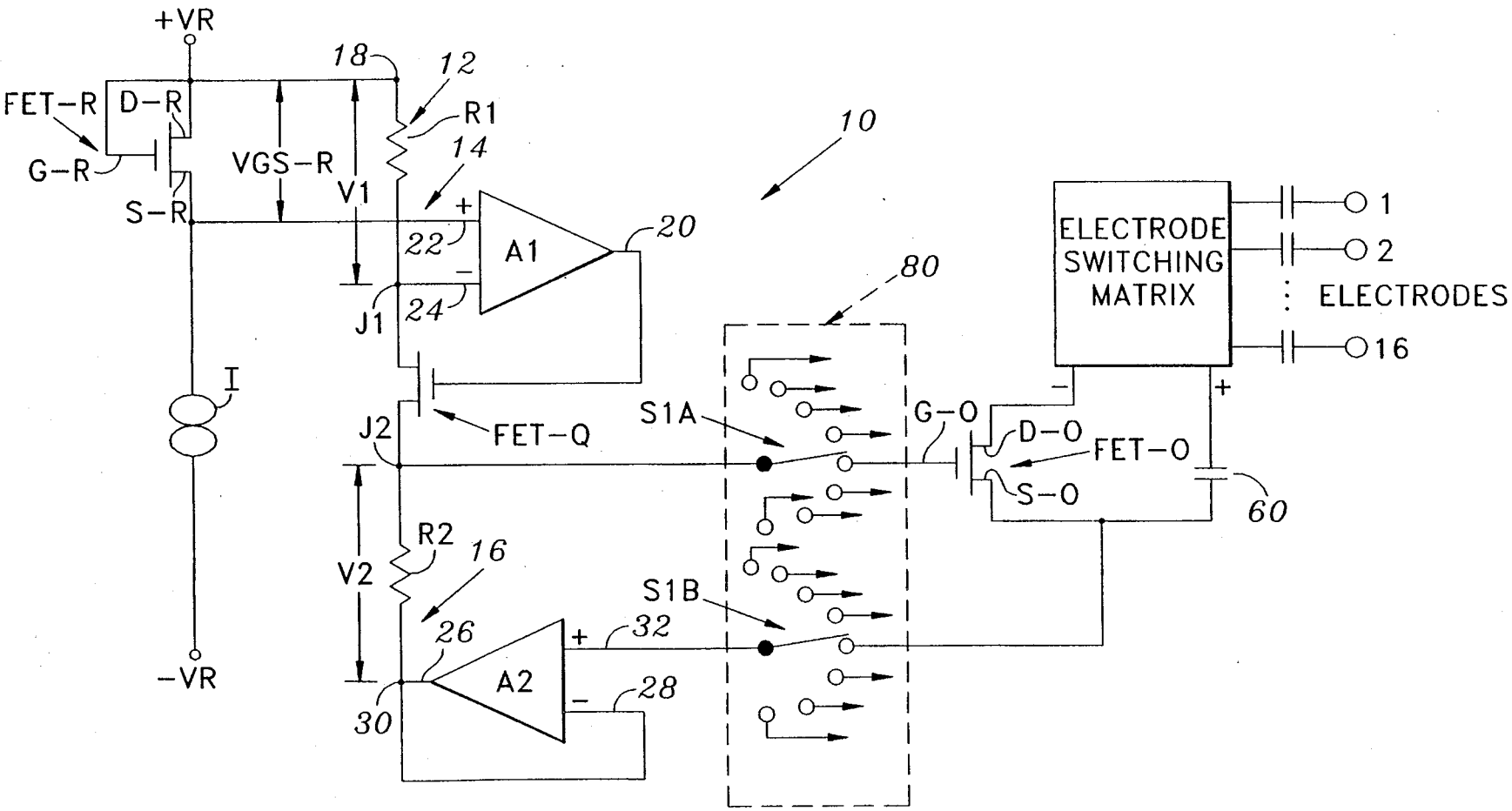
ELECTRODES
1
2
16
ELECTRODE SWITCHING MATRIX
60
FET-O
D-O
S-O
G-O
80
10
S1A
S1B
20
A1
FET-Q
32
28
A2
12
R1
14
22
24
J1
J2
R2
16
26
30
18
V1
V2
VGS-R
I
+VR
-VR
D-R
S-R
FET-R
G-R

FLOATING CURRENT SOURCE

BACKGROUND

The present invention relates to a "floating" current source, that is a source of current that is not directly tied to a power supply, and more particularly to an improved floating current transfer device for supplying stimulating signals to a cochlear electrode.

U.S. patent application Ser. No. 07/411,563, filed Sept. 22, 1989, describes a cochlea stimulating system for improving the hearing of the hearing impaired. One feature of the system described in the patent application is the use of floating current transfer devices for supplying stimulating signals to electrodes implanted within a cochlea of a hearing impaired person. The use of such devices enables an implantable cochlea stimulator to stimulate pairs of electrodes independent of the current flow in other pairs of electrodes and also allows for the exact control of current in each output stage, with no direct current path back to a main power supply or to any other output stage. This eliminates any concern of undesired currents flowing between any of the output stages.

The present invention is directed to a preferred form of such a floating current source and transfer device.

SUMMARY OF INVENTION

The present invention comprises a floating current source including two field effect transistors (FETs). A first one of the FETs (FET-R) defines a reference FET while the other defines a floating output FET (FET-O). The gate of FET-R is and optionally the drain may be connected to a reference voltage (VR) while the source of FET-R is connected to receive an input current from an input current source. FET-R generates a gate-to-source voltage which when applied as a gate-to-source voltage to FET-O will generate an output current in FET-O equal to the input current to FET-R or a multiple thereof. To accomplish this, circuit means are included for applying between the gate and source of FET-O a voltage equal to the gate-to-source voltage of FET-R. Preferably such circuit means includes a series circuit having two matching resistors (R1 and R2), means for generating a voltage V1 across R1 substantially equal to the gate-to-source voltage of FET-R, means for generating a substantially equal voltage V2 across R2, and means for applying V2 across the gate and source of FET-O. When FET-R and FET-O are identically sized, the output current equals the input current.

BRIEF DESCRIPTION OF DRAWING

The drawing is a schematic of a preferred form of the floating current source of the present invention.

DETAILED DESCRIPTION OF INVENTION

The preferred form of the present invention is implemented using CMOS technology. In the development of a prototype of the invention however, standard off-the-shelf electrical components were utilized and functioned in accordance with the general principles and features hereinafter set forth. Accordingly, in duplicating the circuit hereafter described, one may either utilize conventional off-the-shelf electrical components or develop a circuit utilizing techniques well known in CMOS technology, whichever is desired.

Generally speaking, the floating current source of the present invention comprises two field effect transistors FET-R and FET-O. FET-R functions as a reference transistor receiving an input current from a source connected to a power supply (non-floating input current), while FET-O functions as a floating output transistor developing a floating output current equal to or a multiple of the input current.

As previously noted, the floating current source of the present invention preferably comprises the current source 62 included in the system described and shown in FIG. 2 of the aforementioned patent application. More particularly, in that system eight floating current sources 62 are included. Thus, when included in the system of the aforementioned patent application, the output transistor FET-O illustrated in the drawing of this application is one of eight such output transistors connected to one of eight storage capacitors 20 and selectively connected to associated circuit means for the reference transistor FET-R through operation of an analog multiplexer 80. As shown in FIG. 2 of the aforementioned patent application, the multiplexer 80 receives the output of a D-A converter 64. When the floating current source of the present invention comprises the current source 62, the D-A converter 64 includes FET-R and the associated circuit means hereinafter described, including a source of non-floating input circuit. Thus connected in the system of the aforementioned patent application, each output transistor FET-O selectively generates an output current which is selectively applied by a switching matrix 66 to one of 16 electrodes or to 1 of 8 pairs of electrodes. In the drawing, the multiplexer 80 is depicted diagramatically as comprising a pair of single-throw eight-pole switches SIA and SIB. Since the output transistors FET-O are floating with respect to all power supplies, the operation of the multiplexer 80 to selectively connect different pairs of electrodes to the reference transistors, FET-R, allows for exact control of the currents in each output stage of the system of the aforementioned patent application with no direct current path back to a power supply or to any other output stage. This eliminates any concern of undesired currents flowing between any of the output stages. Thus, the present invention when included in the system of the aforementioned patent application provides means whereby isolated electrical signals may be generated on any pair of electrodes independent from the electrical signals on any other pair of electrodes.

More particularly, as illustrated in the drawing of this application, FET-R is an N channel FET having its gate G-R and optionally its drain D-R connected to a reference voltage +VR and its source S-R connected to receive an input current from an input current source I (included in 64 in the aforementioned patent application). The current source I is connected to a power supply-VR and hence is not floating. The output transistor FET-O, on the other hand, is floating with respect to all power supplies.

In the present invention, it is desired to impress upon FET-O a gate-to-source voltage VGS-O which will produce a floating output current corresponding to the nonfloating input current supplied by the source I. This is accomplished by (i) matching FET-R to FET-O, (ii) generating a voltage equal to the gate-to-source voltage (VGS-R) produced in FET-R by the input current from I, and (iii) applying voltage equal to VGS-R across the gate G-O and source S-O of the FET-O (VGSR R=VGS-O). With the gate G-R of FET-R connected to +VR, the voltage generated by I between +VR and the source SR equals the gate-to-drain voltage, VGS-R. With FET-R identically sized to FET-O, VGS-R=the gate-to-source voltage of FET-O required to produce the desired matching output current.

To transfer VGS-R to FET-O, the current source of the present invention includes circuit means 10 for applying between the gate G-O and source S-O of FET-O a voltage equal to the gate-to-source voltage VGS-R of FET-R. Circuit means 10 preferably includes a series circuit 12 having two matching resistors R1 and R2, circuit means 14 for generating a voltage V1 across R1 substantially equal to the VGS-R and circuit means 16 for generating a voltage V2 across R2 substantially equal to the desired VGS-O and for applying V2 across the gate G-O and source S-O of FET.

Preferably, the circuit means 14 includes a connection of a terminal 18 of the series circuit 12 to +VR, an operational amplifier A1, and a P-channel FET Q. FET-Q has its drain-to-source circuit connected in series between R1 and R2 and its gate connected to the output 20 of A1. Inputs 22 and 24 (positive and negative) to A1 are connected to source S-R of FET-R and a junction J1 of R1 and the drain-to-source circuit of Q, respectively.

Preferably, the circuit means 16 comprises a connection of the gate G-O of FET-O through the multiplexer 80 to a junction J2 of R2 and the drain-to-source circuit of Q, and an operational amplifier A2. The output 26 of the operational amplifier and the negative input 28 to the operational amplifier A2 are connected to a second terminal 30 of the series circuit 12 while the positive input 32 to the operational amplifier A2 is connected to the source S-O of FET-O through the multiplexer 80.

In operation, and as previously indicated, the desired gate-to-source voltage VGS-O for FET-O is available as a difference voltage between +VR and the source S-R of FET-R, that is VGS-R. The operational amplifier A2 controls FET-Q so as to cause the input to the operational amplifier at the junction J1 to substantially equal the voltage at S-R. In other words, the output voltage of operational amplifier A1 will change until the amplifier is satisfied that the voltages at its input terminals are equal within the offset voltage of the operational amplifier. Having the voltage at junction J1 equal the voltage at S-R means that a voltage equal to VGS-R is applied across R1 which, by way of example, may be a 50,000 ohm resistor. Current flowing through R1 has only one possible path, and that is to flow through R2 which is a matched or identical resistor. It cannot flow into the high impedence operational amplifier A1 and it cannot flow through the gate of FET-Q, the gate terminal drawing no current. Thus, whatever current flows through R1 is forced to also flow through R2. Since the resistors R1 and R2 are matched, the voltage drop between the junction J2 and the second terminal 30 of the series circuit 12 will match the voltage across R1. In this manner, a voltage equal to VGS-R is applied via the operational amplifier A2 between the gate G-O and source S-O of FET-O (VGS-R=VGS-O). As previously indicated, such a gate-to-source voltage VGS-O produces an output current in FET-O which is equal to the input current from the source I applied to FET-R. Of course, if it is desired that the output current be a multiple or a fraction of the input current, this may be accomplished by sizing FET-R relative to FET-O to accommodate such current control. More particularly, in a preferred form of the present invention, FET-R and FET-O are not only geometrically identical, but they are also on the same chip in close proximity. This assures that the same output current flows in the drain of FET-O as flows in the drain of FET-R. This occurs with no direct connection between FET-O and FET-R. Thus, the output current is floating and is controlled by an input current which is not floating.

Accordingly, the present invention provides an improved floating current source which is ideally suited for use in an implantable cochlea stimulating system for improving the hearing of the hearing impaired.

I claim:

1. A floating current source, comprising:

two field effect transistors FET's, one of said FETs defining a reference FET (FET-R) and the other defining a floating output FET, FET-O;

FET-R having its gate connected to a reference voltage VR, and its source connected to receive an input current from an input current source and to generate a gate-to-source voltage which when applied as a gate-to-source voltage to FET-O will generate an output current in FET-O equal to the input current or a multiple thereof; and circuit means for applying source of FET-O a voltage equal to the gate-to-source voltage of FET-R, including a series circuit having two matching resistors, R1 and R2, means for generating a voltage V1 across R1 substantially equal to the gate-to-source voltage at FET-R, means for generating a substantially equal voltage V2 across R2, and means for applying V2 across the gate and source of FET-O.

2. The current source of claim 1 wherein the two field effect transistors are identically sized.

3. The current source of claim 1 wherein:

the means for generating V1 across R1 comprises means connecting one terminal of the series circuit to VR, an operational amplifier A1 and an FET Q having its drain-to-source circuit connected in series between R1 and R2 and its gate connected to an output of A1, the inputs of A1 being connected to the source of FET-R and a junction of R1 and the drain-to-source circuit in FET Q; and the means for generating V2 across R2 and applying V2 across the gate and source of FET-O comprises means connecting the gate of FET-O to a junction of R2 and the drain-to-source circuit of FET Q, and an operational amplifier A2 having its output and one of its inputs connected to a second terminal of the series circuit and another of its inputs connected to the source of FET-O.

4. The current source of claim 3 further including switch means connected to the gate and source of FET-O for selectively closing to apply V2 to FET-O.

* * * * *